United States Patent [19]

Grainger et al.

[11] Patent Number: 5,030,360

[45] Date of Patent: Jul. 9, 1991

[54] LIQUID-LADEN ASBESTOS COMPACTOR AND METHOD FOR REMOVING LIQUIDS FROM ASBESTOS

[76] Inventors: Murray Grainger, Box 64, R.R. 5, Old Turnpike Rd., Califon, N.J. 07830; Willy C. Dittmar, 79 Lowell Ave., West Orange, N.J. 07052

[21] Appl. No.: 406,450

[22] Filed: Sep. 13, 1989

[51] Int. Cl.[5] ..... B30B 9/04

[52] U.S. Cl. ..... 210/770; 55/421; 100/37; 100/90; 100/122; 100/130; 100/131; 210/335; 210/472; 210/805; 210/806

[58] Field of Search ..... 210/770, 806, 350, 351, 210/472, 805, 335, 188; 100/37, 104, 110, 116, 122, 131, 229 A, 90, 130, 91, 123, 125, 126; 55/421, 466, 500

[56] References Cited

U.S. PATENT DOCUMENTS

| | | | |
|---|---|---|---|
| 700,668 | 5/1902 | Pate | 100/122 |
| 870,512 | 11/1907 | Hershiser | 100/122 |
| 3,881,408 | 5/1975 | Valor | 100/229 A |
| 4,131,661 | 12/1978 | Spitz et al. | 264/183 |
| 4,165,283 | 8/1979 | Weber et al. | 210/313 |
| 4,680,808 | 7/1987 | Paleschuck | 100/229 A |

*Primary Examiner*—W. Gary Jones

*Attorney, Agent, or Firm*—Lerner, David, Littenberg, Krumbolz & Mentlik

[57] ABSTRACT

A receptacle for use in compacting liquid-laden asbestos-containing material to separate the liquids therefrom, the receptacle being adapted to be compacted within a compactor, wherein the receptacle is liquid permeable and capable of retaining a substantial portion of the asbestos-containing material when compacted within the compactor so that a quantity of the liquids are separated from the asbestos-containing material and expelled from the receptacle when the receptacle is compacted within the compactor. A method for separating liquids from liquid-laden asbestos-containing material comprising collecting liquid-laden asbestos-containing material in a liquid permeable receptacle capable of retaining a substantial portion of the asbestos-containing material when the receptacle is compacted, and then compacting the receptacle so that a quantity of the liquids are separated from the asbestos-containing material and expelled from the receptacle.

20 Claims, 1 Drawing Sheet

LIQUID-LADEN ASBESTOS COMPACTOR AND METHOD FOR REMOVING LIQUIDS FROM ASBESTOS

BACKGROUND OF THE INVENTION

This invention relates to a method and apparatus for removing liquids from materials that contain liquid-laden asbestos and in particular to a method and apparatus for compacting and removing liquid from materials which contain asbestos that have become liquid-laden as the result of being wet-down during the course of asbestos abatement procedures. By separating and expelling a portion of the liquids from the asbestos-containing material, and by compacting the remaining asbestos-containing material, the method and apparatus thereby achieves a great reduction in the cost of removal, clean-up, transportation and permanent storage of the actual asbestos-containing material.

Commonly used methods of asbestos abatement control the generation of airborne asbestos fibers to limit employee exposure by "wetting down," or soaking, asbestos-containing material to be handled, cut or removed, with water or other wetting agents or liquid encapsulants. The wet-down asbestos-containing material is then disposed of according to procedures mandated by federal and state regulations in which the wet-down material is placed into appropriately labeled impermeable containers and transported to an approved disposal site.

Currently the wet-down material placed into impermeable containers can contain by weight and volume or bulk as little as 25% asbestos-containing material and as much as 75% water and other liquids. Transportation and disposal charges are based on weight and volume or bulk, which means that up to three-fourths of the cost of transporting and disposing of removed asbestos-containing material can be for the transport and disposal of the water and other liquids used to wet-down the asbestos-containing material. Separation of water and other liquids from wet-down asbestos-containing material prior to placement of the material into impermeable containers will significantly reduce the cost of transporting and disposing of the material, which is a considerable portion of the cost of a typical asbestos abatement project.

Separation of water and other liquids from wet-down asbestos-containing material will also reduce the volume and bulk of material disposed of, which will conserve the available space in approved disposal sites and thereby achieve long term savings in the cost of asbestos abatement as well as in the cost of toxic waste clean-up in general.

U.S Pat. No. 4,680,808 discloses an airborne refuse compactor for airliner galleys that accommodates a trash bag made from a hydrophobic material capable of retaining liquid in the trash until compacting force and suction are applied to the bag. The materials disclosed are 6 ½ ounces per 40 inch wide linear yard grade dacron or 120 to 170 denier weave nylon having a weight of 5 ounces per 40 inch wide linear yard. Upon application of compacting force in combination with suction, the liquid is drawn through the bag and removed from the trash, which is simultaneously compacted. The separated liquid is then either dumped overboard or received by the aircraft liquid drain collection system for subsequent removal. While this system functions to separate liquids from the coarse refuse collected on commercial airliners, it would not function to separate water or other liquids from the fine asbestos fibers found in asbestos-containing materials.

A compactor system capable of separating water and other liquids from wet-down asbestos-containing material while retaining substantially all of the asbestos-containing material would be highly desirable.

SUMMARY OF THE INVENTION

It has now been discovered that water and other liquids can be separated from liquid-laden asbestos-containing materials with a high degree of efficiency by using in combination with a compactor a receptacle for the collection of asbestos-containing materials laden with one or more liquids, which receptacle is liquid permeable, adapted to be compacted within the compactor and capable of retaining a substantial portion of the asbestos-containing material when being compacted within the compactor so that a quantity of the liquids are separated from the asbestos-containing material and expelled from the receptacle. The compacted receptacle may then be placed into an impermeable container for transportation and disposal in accordance with applicable regulations.

Among the preferred embodiments of the present invention are compactors having means for collecting the expelled liquids from the receptacle. In more preferred embodiments of the invention, the compactors further contain means for storing the collected liquids, filtering means for removal from the expelled liquids of any asbestos-containing material not retained by the receptacle, and may also include discharging means for disposal of the filtered liquid or means for recycling the filtered liquid for further use as an asbestos abatement wet-down medium.

The compacting of the receptacle will also release air from the receptacle and preferred embodiments of the invention will include compactors having means for the release of this air. In more preferred embodiments of the invention the compactors further contain means for filtering the expelled air of any asbestos-containing material not retained by the receptacle, prior to the release of the expelled air.

Methods of separating water and other liquids from liquid-laden asbestos-containing materials according to the present invention include the steps of collecting asbestos-containing materials laden with water or other liquids in a liquid permeable receptacle capable of containing the material when the receptacle is compacted, and compacting the receptacle containing the liquid-laden asbestos-containing material collected so that a quantity of the liquids is separated from the liquid-laden asbestos-containing material and expelled from the receptacle. The method may further include storing the compacted receptacle in an impermeable container for transportation and disposal.

Preferred methods of the present invention include the step of collecting the liquids expelled from the receptacle. More preferred methods include the steps of storing the collected liquid and filtering the expelled liquid so that any asbestos-containing material not retained by the receptacle is removed, and may also include the step of discharging the filtered liquid so that it may be disposed of or the step of recycling the filtered liquid so that it may be further used as an asbestos abatement wet-down medium.

Other preferred methods of the present invention include the step of releasing any air expelled from the receptacle. More preferred methods include the step of filtering the expelled air of any asbestos-containing material not returned by the receptacle prior to the step of releasing the expelled air.

The present invention takes advantage of the fact that the expulsion of liquids from a liquid permeable receptacle loaded with liquid-laden asbestos-containing materials is promoted by the application of compacting force to the receptacle. By utilizing a receptacle capable of retaining a substantial portion of the asbestos-containing material during the application of compacting force, a substantial portion of the liquids with which the asbestos-containing material is laden can be separated therefrom.

DETAILED DESCRIPTION OF THE PREFERRED EMBODIMENT

A compactor-receptacle combination according to one aspect of the present invention has a portable compactor holding a porous bag. The compactor is placed in a work containment area and liquid-laden asbestos-containing material, as well as other wet asbestos contaminated items including but not limited to contaminated work clothing, tools, accessories and the asbestos-containing liquid- and air-filtering cartridges, any or all of which are placed into the porous bag. The liquids with which the asbestos-containing material is laden are defined as the water, wetting agents or liquid encapsulants utilized to wet-down the asbestos-containing material as part of an abatement method. The compactor squeezes the asbestos-containing material in the bag, separating a quantity of the liquids from the liquid-laden asbestos-containing material and expelling the separated liquids from the porous bag. The compactor collects and stores the liquids expelled and then filters and discharges the liquids. The bag and the asbestos-containing material retained by the bag are removed from the compactor and placed in an appropriately labeled impermeable container conforming to applicable asbestos disposal regulations. The impermeable container is then sealed and transported to an approved disposal site.

Preferably, the quantity of the liquids separated from the liquid-laden asbestos material is that quantity which provides the asbestos-containing material with the minimum content of liquids permitted by federal, state or local regulation. More preferably, a substantial quantity of liquids will be separated to render the asbestos-containing material substantially dry.

Figure 1:
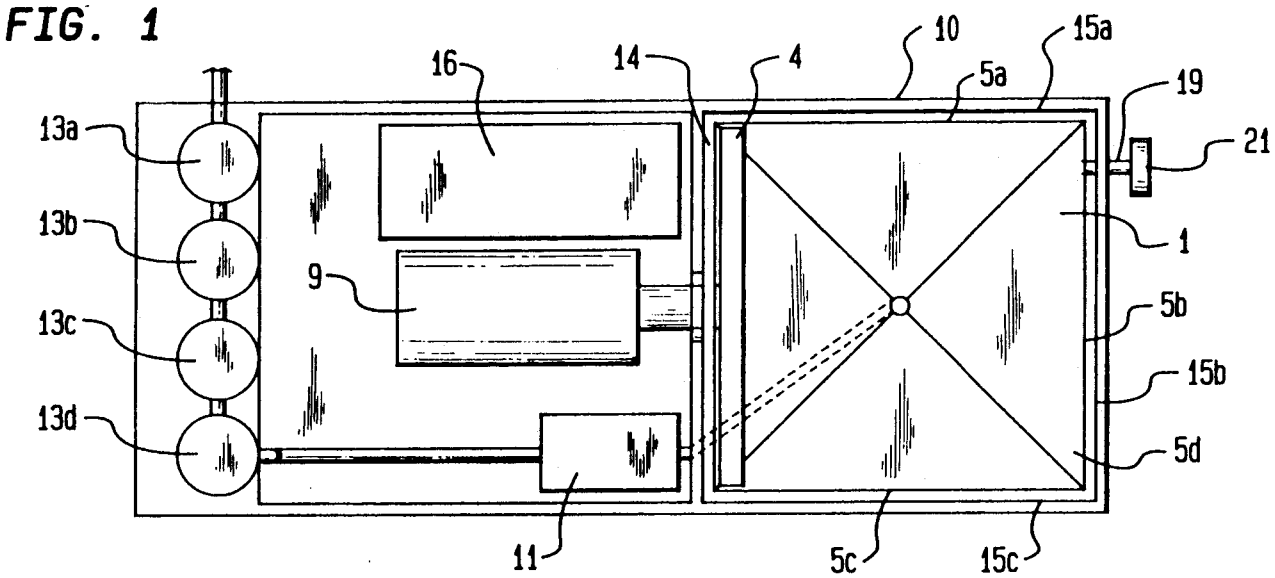
FIGS. 1-3 are schematic, idealized views of a compactor-receptacle combination according to one embodiment of the invention.
Figure 2:
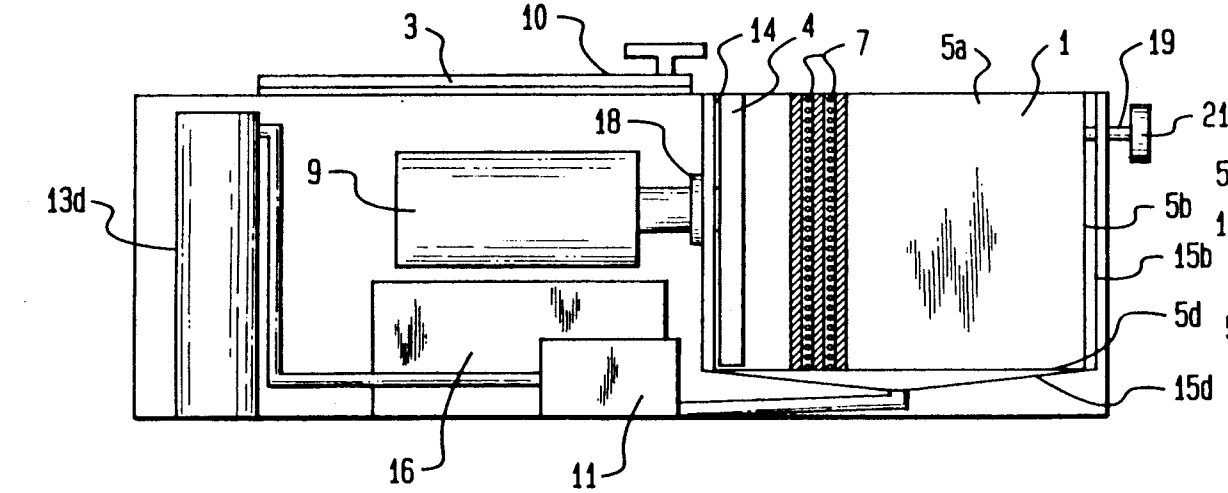
Figure 3:
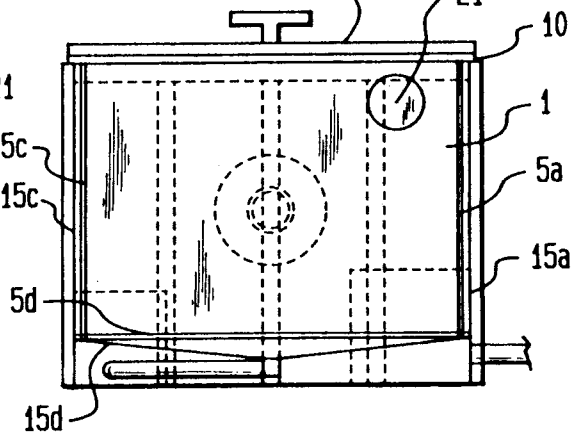

The mechanical structure of the compactor-receptacle combination according to this embodiment of the present invention is depicted in FIGS. 1-3. The compactor 10, consists of a chamber 1, for holding a fabric bag receptacle (not shown) into which liquid-laden asbestos-containing material is loaded from the top through a sliding air-tight door 3 (FIG. 2) that seals the chamber during compaction to prevent asbestos-containing material from escaping into the environment. The chamber is defined by the top sliding air-tight door, side walls 5*a*, 5*b*, and 5*c*, bottom wall 5*d* and a sideways moving ram 4. Perforations and channels 7 (FIG. 2) allow passage of air and liquids expelled from the bag, and direct the flow of the liquid. Although shown in FIG. 2 on only a portion of side wall 5*a*, the perforations and channels are placed continuously throughout side walls 5*a–c*, bottom wall 5*d* and ram 4. The chamber is of double-walled construction, having inner side walls 15*a–c* and inner bottom wall 15*d*, along which the expelled liquids that have passed through the perforated walls collect. An inner side wall 14 also collects the expelled liquids that have passed through the perforations of the ram. The ram, acting from the side, provides the compacting force, and is powered by a hydraulic piston 9, driven by an electrically powered pump, 16. A piston seal 18 provides an air-tight seal between the ram and the chamber. The expelled liquid, mostly water, runs down the sides of outer walls 14 and 15*a–c* and is collected in a sealed storage tank 11 having a float activated pump (not shown), which feeds the liquid to a bank of replaceable cartridge filters 13*a–d* mounted on the compactor. The filters are essentially conventional and remove any asbestos-containing material not retained by the porous bag. The filtered liquid is then drained into a sewer line (not shown). The expelled air passes to exhaust pipe 19 where it exits through filter 21. This filter is also essentially conventional and removes any asbestos-containing material that escapes the bag through the air.

The porous bag receptacle is formed from liquid permeable fabrics capable of retaining a substantial portion of the asbestos-containing material while being compacted. Preferably, the fabrics are approved by OSHA as conforming to the requirements of 29 CFR § 1926.58 for fabrics suitable for protective clothing, and provide an effective barrier against asbestos fibers. It is also preferable that the fabric be resistant to tearing, and more preferable that it be resistant to tearing when being compacted. Among the fabrics meeting these requirements that are suitable for filtering of asbestos fibers are three-layer polypropylene spun olefin fabrics, such as KLEENGUARD® brand three-layer polypropylene spun olefin fabric manufactured by Kimberly Clark. However, any fabric capable of providing a barrier against asbestos fibers in a manner equivalent to the function of the three-layer polypropylene spun olefin fabric is suitable for use in the present invention.

The compacted bag is then removed and placed in an impermeable container pursuant to regulations governing asbestos remediation and disposal (not shown). In this embodiment the impermeable container is a 6 MIL polyethylene bag.

In operation, liquid-laden asbestos-containing materials are loaded into the fabric bag receptacle within the compactor chamber. Once the bag is filled, the air-tight door of the chamber is sealed and the bag is compacted by the chamber ram, extracting the liquids from the asbestos-containing material, which liquids are expelled by the compacting force from the porous bag. The perforations and channels of the ram and chamber walls direct the expelled liquids, to the storage tank. The liquids are then filtered and discharged. The fabric bag of asbestos-containing material from which a quantity of liquid has been removed is then sealed in the impermeable container.

The filtered liquids, instead of being discharged, may be recycled for further use as an asbestos abatement wet-down medium. It is contemplated that when water is used as the wet-down medium, and hence, the liquid extracted is essentially water, then this water, once filtered, will simply be discharged into the local sewer system. However, when the wet-down medium is a wetting agent or liquid encapsulant, then these liquids, when extracted and filtered, can be recycled and used again as a wet-down medium.

It is recognized and contemplated that the method and apparatus of the present invention is not limited in application to the separation of liquids from wet-down asbestos-containing material produced by an asbestos abatement method. The liquid-laden asbestos-containing material can also be produced by methods of clean-up and control of airborne asbestos fiber levels during the handling, installation, renovation or repair of asbestos-containing materials. The method and apparatus of the present invention is also applicable to the separation of liquids from liquid-laden asbestos-containing material produced in these other manners.

The compactor-receptacle combination and compacting method described herein make it possible to more efficiently dispose of liquid-laden asbestos-containing material. While in the past the liquid-laden material was directly loaded into impermeable containers for disposal, the present invention by eliminating a quantity of the liquids from the asbestos-containing materials, reduces both the net weight and the bulk of the actual asbestos-containing materials, thereby greatly reducing the cost of removing, transporting and storing the asbestos-containing materials, and, at the same time it also helps to conserve the limited and scarce space in available approved storage sites.

The invention being thus described, it will be obvious that the same can be varied in many ways. Such variations are not to be regarded as a departure from the spirit and scope of the invention, and all such modifications are intended to be included within the scope of the following claims.

We claim:

1. In combination a compactor and receptacle for the collection of liquid-laden asbestos-containing material adapted to be compacted within said compactor, wherein said receptacle is formed from a liquid permeable asbestos fiber barrier fabric capable of retaining a substantial portion of said asbestos-containing material when being compacted within said compactor so that a quantity of said liquid is separated from said liquid-laden asbestos-containing material and expelled from said receptacle when said receptacle is compacted within said compactor.

2. The combination of claim 1, wherein said compactor further comprises means for collecting said liquids expelled from said receptacle.

3. The combination of claim 2, wherein said compactor further comprises means for storing said collected liquids.

4. The combination of claim 1, wherein said compactor further comprises means for filtering said expelled liquids for removal of asbestos-containing material not retained by said receptacle.

5. The combination of claim 4, wherein said compactor further comprises means for discharging said filtered liquids.

6. The combination of claim 1, wherein air is expelled from said receptacle with said liquid when said receptacle is compacted within said compactor and said compactor further comprises means for releasing said expelled air.

7. The combination of claim 6, wherein said compactor further comprises means for filtering said expelled air, prior to the release of said air, for removal of asbestos-containing material not retained by said receptacle.

8. The combination of claim 1, wherein said fabric comprises a three-layer polypropylene spun olefin.

9. A method for separating liquids from liquid-laden asbestos-containing materials, which method comprises the steps of:

collecting liquid-laden asbestos-containing materials in a receptacle formed from a liquid-permeable asbestos fiber barrier fabric capable of resisting tearing and retaining a substantial portion of said asbestos-containing material when said receptacle is compacted; and compacting said receptacle having liquid-laden asbestos-containing materials collected therein so that a quantity of said liquids is separated from said liquid-laden asbestos-containing material and expelled from said receptacle.

10. The method of claim 9, wherein said receptacle is compacted so that a substantial portion of said liquids are separated and expelled therefrom.

11. The method of claim 9, further comprising the step of storing said compacted receptacle in an impermeable container for transportation and disposal.

12. The method of claim 9, further comprising the step of collecting said liquids expelled from said receptacle.

13. The method of claim 12, further comprising the step of storing said collected liquids.

14. The method of claim 9, further comprising the step of filtering said expelled liquids so that any asbestos-containing material not retained by said receptacle is removed from said expelled liquids.

15. The method of claim 14, further comprising the step of discharging said filtered liquids.

16. The method of claim 14, further comprising the step of recycling said filtered liquids.

17. The method of claim 9, wherein air is expelled from said receptacle and said method further comprises the step of releasing said expelled air from said compactor.

18. The method of claim 17, further comprising the step of filtering said expelled air prior to the step of releasing said expelled air so that any asbestos-containing material not retained by said receptacle is removed from said expelled air.

19. In combination a compactor and a receptacle for the collection of liquid-laden asbestos-containing material adapted to be compacted within said compactor, wherein said receptacle is formed from three-layer polypropylene spun olefin fabric capable of retaining a substantial portion of said asbestos-containing material and being compacted within said compactor so that a quantity of said liquid is separated from said liquid-laden asbestos-containing material and expelled from said receptacle when said receptacle is compacted within said compactor.

20. A method for separating liquids from liquid-laden asbestos-containing materials, which method comprises the steps of:

collecting liquid-laden asbestos-containing material in a receptacle formed from three-layer polypropylene spun olefin fabric capable of resisting tearing and retaining a substantial portion of said asbestos-containing material when said receptacle is compacted; and compacting said receptacle having liquid-laden asbestos-containing materials collected therein so that a quantity of said liquid is separated from said liquid-laden asbestos-containing material and expelled from said receptacle.

* * * * *